US007353787B2

(12) United States Patent
Asano et al.

(10) Patent No.: US 7,353,787 B2
(45) Date of Patent: Apr. 8, 2008

(54) ELECTROMAGNETICALLY DRIVEN VALVE

(75) Inventors: Masahiko Asano, Toyota (JP); Yutaka Sugie, Nishikamo-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/492,755

(22) Filed: Jul. 26, 2006

(65) Prior Publication Data

US 2007/0028870 A1 Feb. 8, 2007

(30) Foreign Application Priority Data

Aug. 8, 2005 (JP) ..... 2005-229682

(51) Int. Cl.
*F01L 9/04* (2006.01)

(52) U.S. Cl. ..... 123/90.11; 123/90.16; 251/129.01

(58) Field of Classification Search ..... 123/90.11; 251/129.01, 129.15, 129.1
See application file for complete search history.

(56) References Cited

U.S. PATENT DOCUMENTS

| | | | | |
|---|---|---|---|---|
| 6,467,441 | B2 | 10/2002 | Cristiani et al. | |
| 6,516,758 | B1 * | 2/2003 | Leiber | 123/90.11 |
| 6,683,775 | B2 | 1/2004 | Rossi et al. | |
| 6,718,918 | B2 | 4/2004 | Meintschel et al. | |
| 7,207,164 | B2 * | 4/2007 | Bomleny | 56/10.2 E |
| 2001/0054401 | A1 | 12/2001 | Cristiani et al. | |
| 2002/0020372 | A1 | 2/2002 | Stolk et al. | |
| 2002/0057154 | A1 | 5/2002 | Keck | |
| 2002/0069842 | A1 | 6/2002 | Curtis et al. | |
| 2003/0150414 | A1 * | 8/2003 | Hilbert et al. | 123/90.11 |

FOREIGN PATENT DOCUMENTS

| | | |
|---|---|---|
| DE | 197 12 669 A1 | 10/1998 |
| DE | 199 28 006 A1 | 12/2000 |
| DE | 100 20 896 A1 | 10/2001 |
| DE | 100 25 491 A1 | 12/2001 |
| DE | 101 26 025 A1 | 1/2002 |
| DE | 100 53 596 A1 | 5/2002 |
| EP | 0 395 450 A1 | 10/1990 |

(Continued)

OTHER PUBLICATIONS

Chinese Language Office Action, Appln. No. 200610107578.2, issued on Oct. 12, 2007.

(Continued)

*Primary Examiner*—Zelalem Eshete
(74) *Attorney, Agent, or Firm*—Kenyon & Kenyon LLP

(57) ABSTRACT

An electromagnetically driven valve that operates by a combination of electromagnetic force and elastic force includes a valve element that has a valve shaft and that reciprocates in directions of extension of the valve shaft, and first and second oscillating members that extend from driving ends to pivoting ends, and that pivot about central axes extending at the pivoting ends. The driving ends are operatively linked with the valve element. An electromagnet oscillates the first and second oscillating members. First and second measuring portions measure at least one of the oscillation angle, the amount of lift and the oscillating speed of the first and second oscillating members. A control portion computes energization control logics based on measurement values provided by the first and second measuring portions, and averages the energization control logics to control energization of the electromagnet.

4 Claims, 4 Drawing Sheets

FOREIGN PATENT DOCUMENTS

| | | | |
|---|---|---|---|
| EP | 1 008 730 | A2 | 6/2000 |
| EP | 1 036 964 | A1 | 9/2000 |
| EP | 1 087 110 | A1 | 3/2001 |
| EP | 1 091 368 | A1 | 4/2001 |
| EP | 1 136 660 | A1 | 9/2001 |
| EP | 1152129 | A1 | 11/2001 |
| EP | 1 170 469 | A1 | 1/2002 |
| EP | 1 209 328 | A2 | 5/2002 |
| EP | 1 296 024 | A1 | 3/2003 |
| FR | 2 812 026 | | 1/2002 |
| JP | A 11-101110 | | 4/1999 |
| WO | WO 2006/018931 | A1 | 2/2006 |

OTHER PUBLICATIONS

English Translation of Chinese Office Action, Appln. No. 200610107578.2, issued on Oct. 12, 2007.

* cited by examiner

ELECTROMAGNETICALLY DRIVEN VALVE

INCORPORATION BY REFERENCE

The disclosure of Japanese Patent Application No. 2005-229682 filed on Aug. 8, 2005 including the specification, drawings and abstract is incorporated herein by reference in its entirety.

BACKGROUND OF THE INVENTION

1. Field of the Invention

The invention generally relates to an electromagnetically driven valve and, more particularly, to a pivot-type electromagnetically driven valve for use in an internal combustion engine which is driven by elastic force and electromagnetic force.

2. Description of the Related Art

Related-art electromagnetically driven valves are disclosed in, for example, U.S. Pat. No. 6,467,441.

In the case where a related-art electromagnetically driven valve employs a plurality of discs, there is a problem that precision control cannot be achieved if it is attempted to control the valve by sensing the movement of a single disc via a single sensor, since the discs do not move uniformly due to dimensional tolerances and mounting precision.

Another problem with the related art is that when the discs are in a neutral position, the air gap is large, and the valve cannot be moved easily unless increased electric power is supplied.

Still another problem is that, due to variations in dimensions and mounting precision, the core and the discs do not make completely close contact with each other, and therefore fail to obtain desired electromagnetic force, resulting in unstable operation of the valve.

SUMMARY OF THE INVENTION

An electromagnetically driven valve in a first aspect of the invention is an electromagnetically driven valve that operates by a combination of electromagnetic force and elastic force, and includes a valve element that has a valve shaft and that reciprocates in directions of extension of the valve shaft, and a first oscillating member and a second oscillating member that extend from driving ends to pivoting ends, and that pivot about central axes extending at the pivoting ends, as well as an electromagnet that oscillates the first oscillating member and the second oscillating member. The driving ends are operatively linked with the valve element. The electromagnetically driven valve also includes a first measuring portion and a second measuring portion that measure at least one of an oscillation angle, an amount of lift and an oscillating speed of the first oscillating member and the second oscillating member, and a control portion that computes energization control logics based on measurement values provided by the first measuring portion and the second measuring portion, and that averages the energization control logics to control energization of the electromagnet.

Since the electromagnetically driven valve in the first aspect performs control by averaging the movements of the plurality of oscillating members, the control in this aspect achieves higher precision than the control that is based on the movement of one disc on the assumption that the other disc or discs move in the same manner. Thus, it is possible to provide an electromagnetically driven valve capable of reliable operation.

An electromagnetically driven valve in a second aspect of the invention is an electromagnetically driven valve that operates by a combination of electromagnetic force and elastic force, and includes a valve element that has a valve shaft and that reciprocates in directions of extension of the valve shaft, and an oscillating member that pivots about an oscillation center and that has a first arm portion and a second arm portion each of which extends from the oscillation center to an end portion. The first arm portion drives the valve element. The electromagnetically driven valve also includes a first electromagnet that faces the first arm portion and that is capable of attracting the first arm portion by electromagnetic force, a second electromagnet that faces the second arm portion and that is capable of attracting the second arm portion by electromagnetic force, an urging portion that urges the second electromagnet in such a direction as to approach the second arm portion, and a stopper that restricts a movement of the second electromagnet in such a direction as to approach the second arm portion. When the oscillating member is in a position where the first electromagnet is not attracting the first arm portion, the second electromagnet is restricted in a movement by the stopper, and a distance between the second electromagnet and the second arm portion is less than a distance between the first electromagnet and the first arm portion.

In the electromagnetically driven valve of the second aspect of the invention, the distance between the second electromagnet and the second arm portion is less than the distance between the first electromagnet and the first arm portion. Therefore, when the oscillating member is near the neutral position, the second electromagnet can attract the second arm portion. Thus, it is possible to provide an electromagnetically driven valve that generates enhanced attraction force in the neutral position and that is capable of reliable operation.

An electromagnetically driven valve in a third aspect of the invention is an electromagnetically driven valve that operates by a combination of electromagnetic force and elastic force, and includes a valve element that has a valve shaft and that reciprocates in directions of extension of the valve shaft, an oscillating member that extends from a driving end to a pivoting end, and that pivots about a central axis extending at the pivoting end. The driving end is operatively linked with the valve element. A first electromagnet and a second electromagnet that oscillate the oscillating member, and a first holding portion and a second holding portion that movably hold the first electromagnet and the second electromagnet.

In the electromagnetically driven valve of the third aspect of the invention, the first and second electromagnets are movably held. Therefore, the first and second electromagnets are able to have close contact with the oscillating member even if there are variations in the dimensions and mounting precision of the electromagnets and the oscillating member. Hence, it is possible to provide an electromagnetically driven valve capable of reliable operation.

According to the invention, it is possible to provide an electromagnetically driven valve capable of reliable operation.

BRIEF DESCRIPTION OF THE DRAWINGS

The foregoing and/or further objects, features and advantages of the invention will become more apparent from the following description of preferred embodiment with reference to the accompanying drawings, wherein like numerals are used to represent like elements and wherein.

DETAILED DESCRIPTION OF THE PREFERRED EMBODIMENTS

Figure 1:
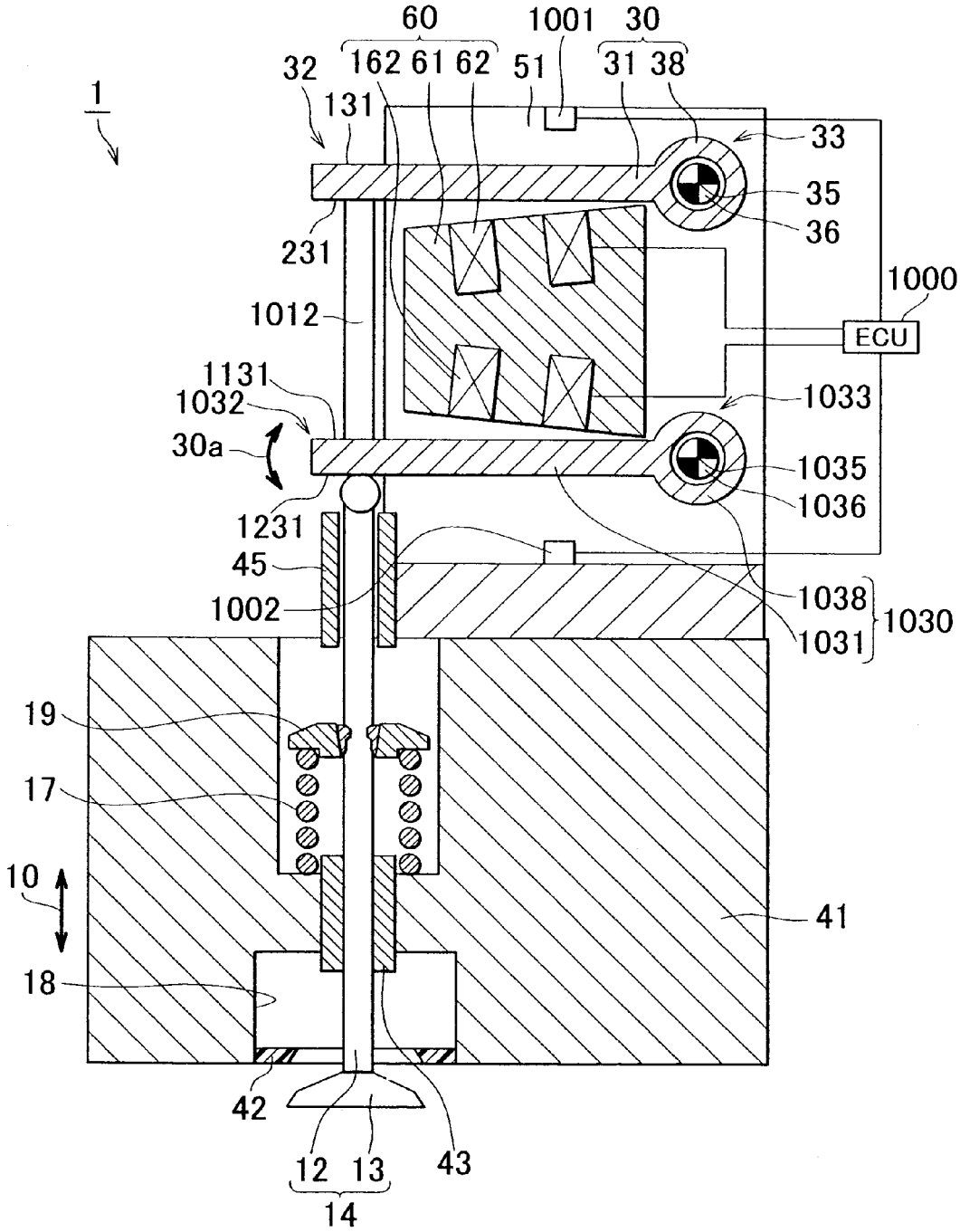
FIG. 1 is a cross-sectional view of an electromagnetically driven valve in accordance with a first embodiment of the invention.

Embodiments of the invention will be described hereinafter with reference to the accompanying drawings. As for the embodiments below, the same or comparable elements, portions, etc. are represented by the same reference characters in the drawings, and redundant description thereof will be avoided.

Hereinafter, a first embodiment of the invention will be described. FIG. 1 is a cross-sectional view of an electromagnetically driven valve in accordance with the first embodiment of the invention. The electromagnetically driven valve 1 in accordance with the first embodiment of the invention has a main body 51, an electromagnet 60 attached to the main body 51, and an upper disc 30 and a lower disc 1030 located at opposite sides of the electromagnet 60, as well as a valve element 14 that is driven by the discs 30, 1030.

The main body 51 is a base member, to which various components are attached. The electromagnet 60 is attached to the main body 51 has a core 61 that is made of a magnetic material, and coils 62, 162 wound on the core 61. Energization of the coils 62, 162 creates magnetic fields, which drive the disc 30 and the disc 1030. The discs 30, 1030 are disposed so as to sandwich the electromagnet 60, and one of the discs 30, 1030 is attracted to the electromagnet 60. Thus, the discs 30, 1030 both reciprocate in such a direction as to approach the electromagnet 60 and in such a direction as to move away from the electromagnet 60. The reciprocating movements thereof are transferred to a valve stem 12 via a stem 1012.

The electromagnetically driven valve 1 is an electromagnetically driven valve that operates by combination of electromagnetic force and elastic force. The electromagnetically driven valve 1 includes the valve element 14 that has the valve stem 12 as a valve shaft and that reciprocates in the directions (arrows 10) of extension of the valve stem 12, and the main body 51 as a support member that is provided at a position spaced from the valve element 14. The electromagnetically driven valve 1 further includes the discs 30, 1030 as first and second oscillating members that extend from driving ends 32, 1032 to pivoting ends 33, 1033, and that pivot about central axes 35, 1035 extending at the pivoting ends 33, 1033. The driving ends 32, 1032 are operatively linked with the valve stem 12. The electromagnet 60 that oscillates the discs 30, 1030, first and second measuring portions 1001, 1002 that measure at least one of the oscillation angle, the amount of lift and the oscillating speed of the discs 30, 1030, and an ECU (electronic control unit) 1000 as a control portion that computes energization control logics on the basis of measurement values provided by the first and second measuring portions 1001, 1002, and that performs a process of averaging the various energization control logics and accordingly controls the energization of the electromagnet. In the invention, energization control logic is a control logic that controls the amount of electric current through the coil 62, 162 of the electromagnet 60 that oscillates the discs 30, 1030. In the energization control logic, the current value is maintained larger than 0 A.

The electromagnetically driven valve 1 in this embodiment is adopted for the intake valves or exhaust valves of internal combustion engines such as gasoline engines, diesel engines, etc. Although in this embodiment, the valve element 14 is an intake valve disposed in an intake port 18, the invention is also applicable to a valve element provided as an exhaust valve.

The electromagnetically driven valve 1 is a pivot drive type electromagnetically driven valve, and employs two discs, that is, the discs 30, 1030, as a motion mechanism. The main body 51 is provided on a cylinder head 41. In the main body 51, the disc 1030 is provided at a lower side, and the disc 30 is provided at an upper side. The electromagnet 60 is positioned between the disc 30 and the disc 1030. The electromagnet 60 includes the core 61 formed by stacking electromagnetic steel plates, and the coils 62, 162 wound on the core 61 for creating magnetic fields. Supplying electric current through the coils 62, 162 creates magnetic fields in regions surrounded by the coils 62, 162. Due to these magnetic fields, the electromagnet 60 can pull the disc 30 and the disc 1030. Specifically, due to a control of the timing of supplying current through the coils 62, 162, the electromagnet 60 can pull the disc 30 or the disc 1030.

The coil 62 facing the disc 30, and the coil 162 facing the disc 1030 may be interconnected or separated from each other. The number of turns of each coil 62, 162 on the core 61 is not particularly limited.

Each of the disc 30 and the disc 1030 has an arm portion 31, 1031 and a bearing portion 38, 1038. The arm portion 31, 1031 extends from the driving end 32, 1032 to the pivoting end 33, 1033. Each arm portion 31, 1031 is a member that is attracted by the electromagnet 60 so as to oscillate (pivot) in the directions indicated by arrows 30*a*. The bearing portion 38, 1038 is provided at an end of the arm portion 31, 1031. The arm portions 31, 1031 are pivotable about the bearing portions 38, 1038. An upper surface 1131 of the arm portion 1031 is capable of contacting a face of the electromagnet 60 where the coil 162 is provided. Likewise, a lower surface 231 of the arm portion 31 is capable of contacting a face of the electromagnet 60 where the coil 62 is provided. In addition, a lower surface 1231 of the arm portion 1031 is in contact with the valve stem 12.

Each bearing portion 38, 1038 has a cylindrical shape, and has therein a torsion bar 36, 1036. A first end portion of the torsion bar 36, 1036 is fitted to the main body 51 by spline fitting, and the other end portion thereof is fitted to the bearing portion 38, 1038. Therefore, when the bearing portion 38, 1038 is pivoted, a force opposing this pivot is transferred from the torsion bar 36, 1036 to the bearing portion 38, 1038. Thus, each bearing portion 38, 1038 is always urged toward a neutral position.

The disc 1030 receives, on the driving end 1032 side, receives force from the disc 30 via the stem 1012, and therefore presses the valve stem 12. A hydro-lash adjuster or the like may be provided between the valve stem 12 and the disc 1030. The valve stem 12 is guided by stem guide 45, 43. The first measuring portion 1001 and the second measuring portion 1002 are attached to the main body 51. The first measuring portion 1001, and the second measuring portion 1002 face the upper surface 131 of the disc 30, and the lower surface 1231 of the disc 1030, respectively. They measure at least one of the oscillation angle (pivot angle), the amount of lift, and the oscillating speed of the disc 30 and the disc 1030.

Measurement data obtained via the first measuring portion 1001 and the second measuring portion 1002 is sent to the ECU 1000. On the basis of the values obtained from the first measuring portion 1001 and the second measuring portion 1002, the ECU 1000 determines at least one of the magnitude of electric current supplied through the coils 62, 162, and the supplying timing. More specifically, there is slight difference between the oscillating movements (the oscillation angle, the amount of lift, the oscillating speed) of the disc 30 and the oscillating movements of the disc 1030. Therefore, the ECU 1000 averages the energization control logics which are computed based on the data regarding the disc 30 measured by the first measuring portion 1001 and the data regarding the disc 1030 measured by the second measuring portion 1002. The ECU 1000 computes energization control logic for electrifying the coils 62, 162 on the basis of the average value, that is, supplying electric current through the coils 62, 162.

The ECU 1000 has a function of determining the amount of electric current supplied to the coils 62, 162 and the duration of flow of electric current therethrough.

The main body 51 of the electromagnetically driven valve 1 is mounted on the cylinder head 41. The intake port 18 is provided in a lower portion of the cylinder head 41. The intake port 18 is a path for introducing intake air into a combustion chamber. That is, air-fuel mixture or air passages through the intake port 18. A valve seat 42 is provided between the intake port 18 and the combustion chamber. By the valve seat 42, the salability of the valve element 14 can be enhanced.

The valve element 14 as an intake valve is mounted in the cylinder head 41. The valve element 14 includes the valve stem 12 extending in the longitudinal directions, and a bell portion 13 attached to an end portion of the valve stem 12. The valve stem 12 is guided by a stem guide 43. The valve element 14 is capable of being reciprocated in the directions indicated by the arrows 10.

A spring retainer 19 is fitted over the valve stem 12. The spring retainer 19 is urged by a valve spring 17. Therefore, the valve stem 12 receives upward force from the valve spring 17.

Next, operations of the electromagnetically driven valve in accordance with the first embodiment will be described. Firstly, to drive the electromagnetically driven valve 1, electric current is supplied to the coils 62, 162 of the electromagnet 60. Thereby, the coils 62, 162 create magnetic fields, so that one of the arm portion 31 of the disc 30 and the arm portion 1031 of the disc 1030 which are both made of a magnetic material is pulled to the electromagnet 60. Which one of the discs is pulled toward the electromagnet 60 is determined by the electromagnetic force generated between the electromagnet 60 and the discs, and the torsion forces of the torsion bar 36, 1036.

In this embodiment, it is assumed that the disc 1030 is pulled to the electromagnet 60. In this case, the arm portions 31, 1031 pivot upward. Therefore, the torsion bars 36, 1036 are twisted, so that the torsion bars 36, 1036 tend to move the arm portions 31, 1031 in the opposite direction. However, due to the strong pulling force of the electromagnet 60, the arm portions 31, 1031 pivot upward until finally the upper surface 1131 of the arm portion 1031 contacts the electromagnet 60. As the arm portions 31, 1031 move upward, the valve stem 12 also moves upward. In this manner, the valve element 14 is closed.

To open the valve element 14, the arm portions 31, 1031 need to be moved downward. To that end, the current flowing through the coil 162 is stopped or reduced. As a result, the electromagnetic force acting between the electromagnet 60 and the arm portion 1031 reduces. The torsion force (elastic forces) acting on the arm portions 31, 1031 from the torsion bars 36, 1036 overcomes the electromagnetic force, so that the arm portions 31, 1031 move to the neutral position as shown in FIG. 1. At this time, the valve stem 12 of the valve element 14 is pushed by the arm portions 31, 1031 to move downward. Then, electric current is supplied to the coil 62. As a result, a magnetic field is created around the coil 62, and the arm portion 31 made of a magnetic material is pulled to the electromagnet 60.

At this time, too, the valve stem 12 of the valve element 14 is pushed by the arm portions 31, 1031 to move downward. The pulling force of the electromagnet 60 overcomes the torsion force of the torsion bars 36, 1036, so that finally the lower surface 231 of the arm portion 31 contacts the electromagnet 60. At this time, the valve element 14 moves downward to assume an open valve state. By alternating the upward movement and the downward movement as described above, the arm portions 31, 1031 pivot back and forth in the directions indicated by the arrows 30*a*. As the arm portions 31, 1031 pivot, the bearing portions 38, 1038 connected to the arm portions 31, 1031 also pivot.

The oscillation angle, the amount of lift and the oscillating speed of the discs 30, 1030 are measured by the first measuring portion 1001 and the second measuring portion 1002, respectively. On the basis of individual movements of the discs 30, 1030, the ECU 1000 prepares dedicated control logics for the discs 30, 1030 separately. By combining these control logics, the ECU 1000 determines the amount of electric current supplied to the coils 62, 162 and the duration of energization so as to control the electromagnet 60.

In the above-described electromagnetically driven valve 1 in accordance with the first embodiment, the control of energization of the electromagnet 60 is performed on the basis of the movements of the two discs 30, 1030, so that the precision of the control improves as compared with the case where only one disc is monitored to perform the energization control. Therefore, it becomes possible to provide an electromagnetically driven valve capable of reliable operation.

Figure 2:
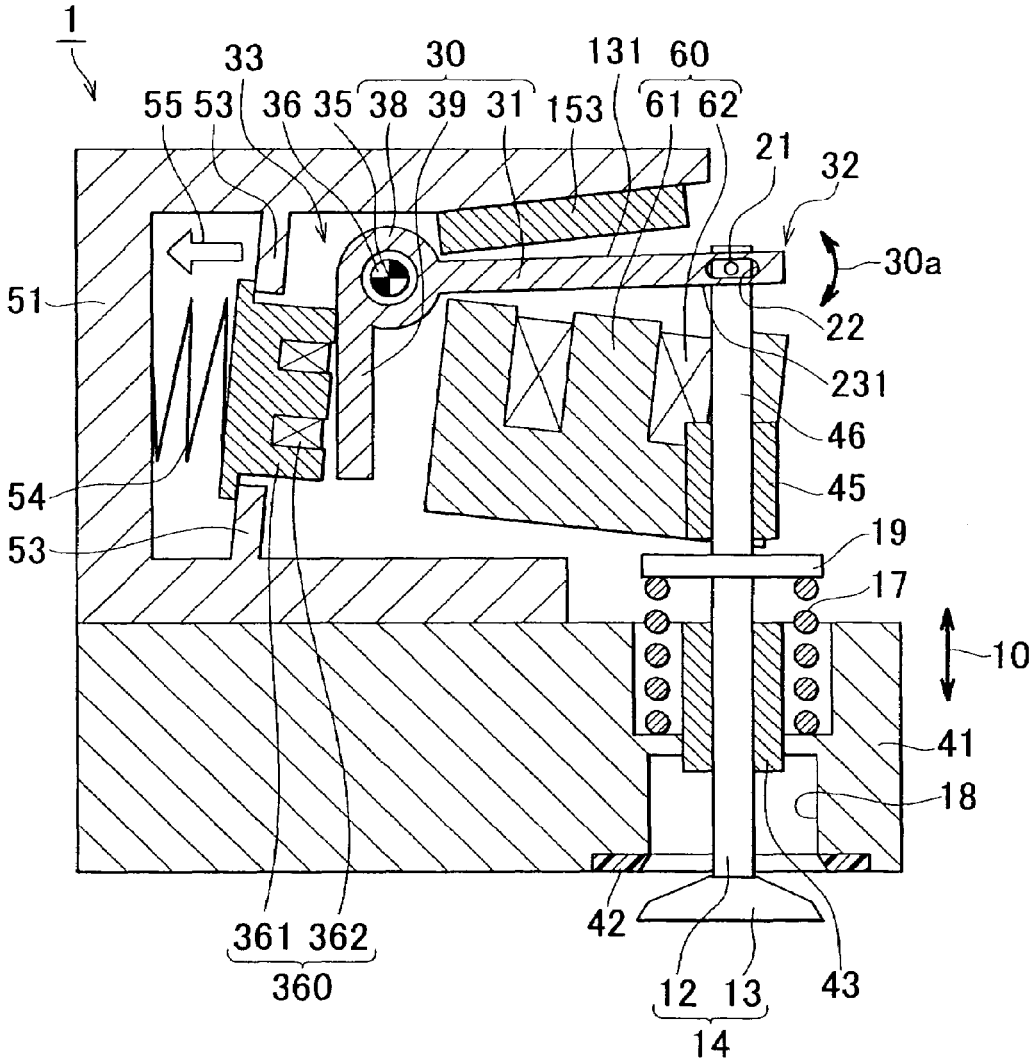
FIG. 2 is a cross-sectional view of an electromagnetically driven valve in accordance with a second embodiment of the invention.

Hereinafter, a second embodiment of the invention will be described. FIG. 2 is a cross-sectional view of an electromagnetically driven valve in accordance with the second embodiment of the invention. An electromagnetically driven valve 1 in accordance with the second embodiment of the invention is an electromagnetically driven valve that operates by combination of electromagnetic force and elastic force. The electromagnetically driven valve 1 includes a valve element 14 that has a valve stem 12 and that reciprocates in the directions (arrows 10) of extension of the valve stem 12, a disc 30 as an oscillating member that pivots about a central axis 35 as an oscillation center and that has an arm portion 31 as a first arm portion and an arm portion 39 as a second arm portion both of which extend from the central axis 35 to their distal ends. The arm portion 31 drives the valve element 14. The electromagnetically driven valve 1 is further provided with a valve-opening electromagnet 60 as a first electromagnet that faces the arm portion 31 and that is capable of attracting the arm portion 31 by electromagnetic force, a near neutral position-dedicated electromagnet 360 as a second electromagnet that faces the arm portion 39 and that is capable of attracting the arm portion 39 by electromagnetic force, a spring 54 as an urging portion that urges the electromagnet 360 toward the arm portion 39, and a stopper 53 that restricts the movement of the electromagnet 360 in such a direction as to approach the arm portion 39. As shown in FIG. 2, during a state where the electromagnet 60 does not attract the arm portion 31, the electromagnet 360 is restricted in movement by the stopper 53, and the distance between the electromagnet 360 and the arm portion 39 is less than the distance between the electromagnet 60 and the arm portion 31.

The main body 51 is provided with a stopper 153 on a closed valve side, and the stopper 53 for the electromagnet 360. When the electromagnetically driven valve 1 is in a neutral position as shown in FIG. 2, there is no electric current flowing though the coil 62 of the electromagnet 60, and the coil 62 does not pull the arm portion 31. The electromagnet 360 includes a core 361 formed of electromagnetic steel plates, and a coil 362 wound on the core 361. The electromagnet 360 is located near the arm portion 39. While the electromagnet 360 is stopped by the stopper 53 from moving in such a direction as to approach the arm portion 39, the electromagnet 360 is allowed to move in such a direction as to move away from the arm portion 39, that is, a direction indicated by an arrow 55. The disc 30 has a shape of "L", with the two arm portions 31, 39 extending from a bearing portion 38. A distal end of a stem 46 is provided with a pin 21. The pin 21 is fitted into an elongated hole 22 formed in a distal end of the arm portion 31.

Figure 3:
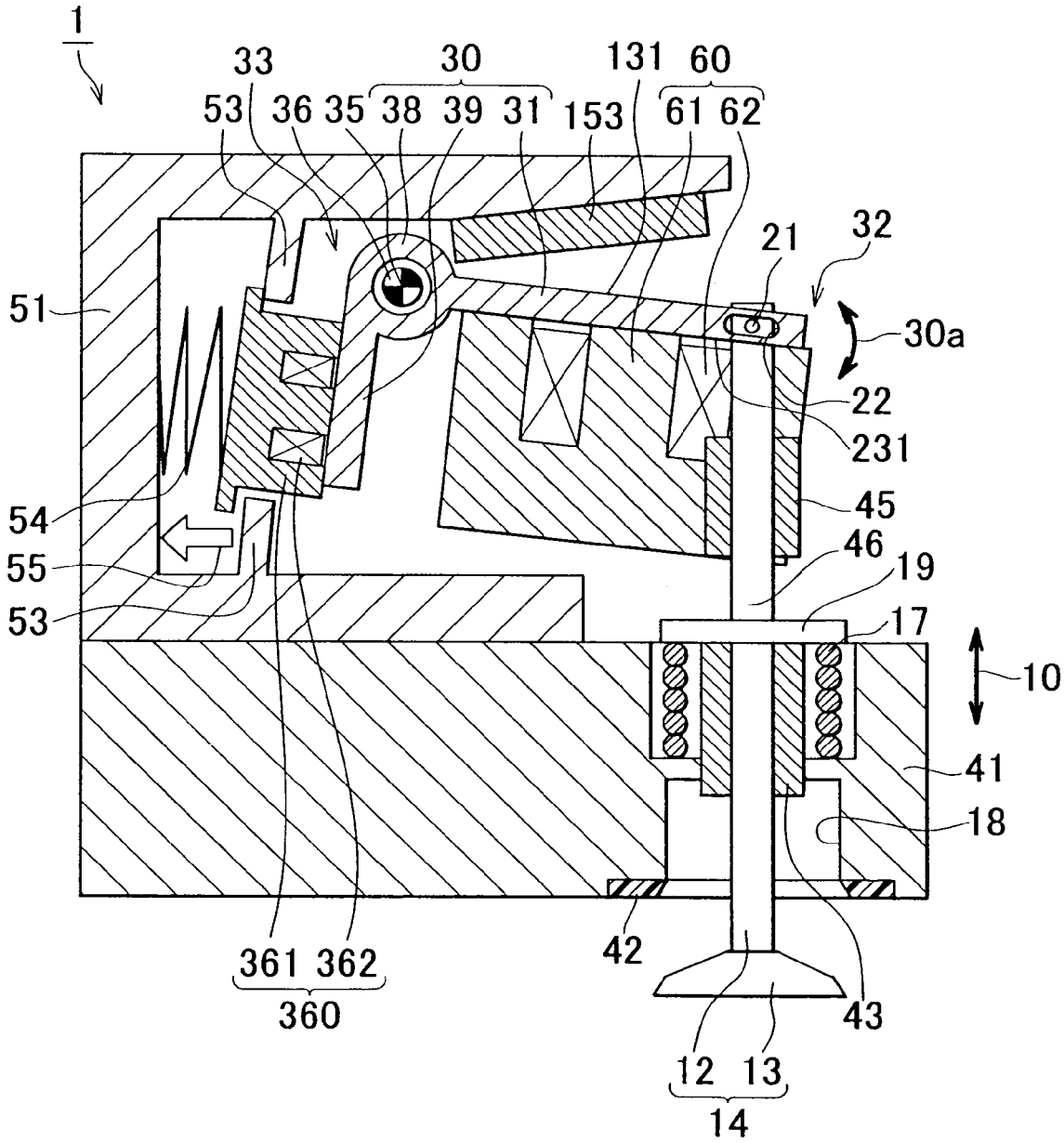
FIG. 3 is a cross-sectional view of the electromagnetically driven valve when the valve is open.

FIG. 3 is a cross-sectional view of the electromagnetically driven valve when the valve is open. When the valve is open, electric current is supplied to the coil 62, and is also supplied to the coil 362. Since the distance between the electromagnet 360 and the arm portion 39 is less than the distance between the electromagnet 60 and the arm portion 31, great electromagnetic force is generated between the electromagnet 360 and the arm portion 39. Therefore, the electromagnet 360 pulls the arm portion 39, so that a great driving force is generated during initial driving. Incidentally, the electromagnet 360 is movable in the direction indicated by the arrow 55. After having contacted the arm portion 39, the electromagnet 360 is slightly moved in the direction indicated by the arrow 55.

The above-described electromagnetically driven valve 1 in accordance with the second embodiment is provided with the electromagnet 360 that is adjacent to the arm portion 39, that is, a portion of the disc 30 when the disc 30 is in the neutral position where the air gap is large. The electromagnet 360 is pressed against the stopper 53 by the spring 54. In this situation, the electromagnet 360 is movable in a direction opposite to the direction to the disc 30. In the proximity of the neutral position up to the contact of the disc 30 with the electromagnet 60, the electromagnet 360 is stopped from moving by the stopper 53, and applies attraction force to the arm portion 39 of the disc 30. After the arm portion 39 contacts the electromagnet 360, the electromagnet 360 moves together with the arm portion 39 to a full lift position. Therefore, the attraction force during such a near neutral position state can be enhanced.

In the second embodiment, the coil 62 and the coil 362 may be of a single wiring, or of separate wirings.

Hereinafter, a third embodiment of the invention will be described.

Figure 4:
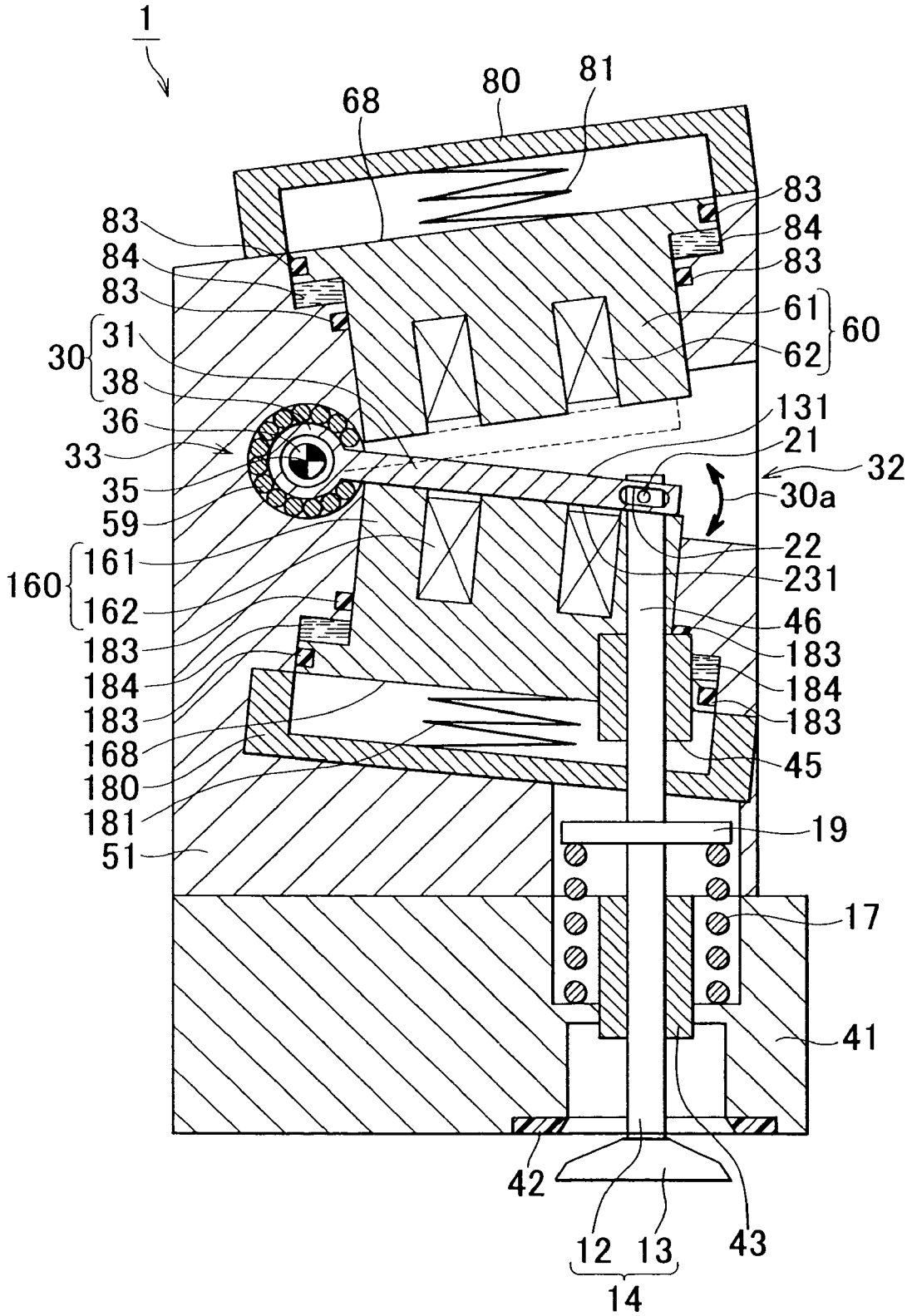
FIG. 4 is a cross-sectional view of an electromagnetically driven valve in accordance with a third embodiment of the invention.

FIG. 4 is a cross-sectional view of an electromagnetically driven valve in accordance with the third embodiment of the invention. An electromagnetically driven valve 1 in accordance with the third embodiment of the invention is an electromagnetically driven valve that operates by combination of electromagnetic force and elastic force. The electromagnetically driven valve 1 includes a valve element 14 that has a valve stem 12 as a valve shaft and that reciprocates in the directions of extension of the valve stem 12, a disc 30 as an oscillating member that extends from a driving end 32 to a pivoting end 33, and that pivots about a central axis 35 extending at the pivoting end 33. A driving end 32 is operatively linked with the valve stem 12. Two electromagnets 60, 160 as first and second electromagnets that oscillate the disc 30, and elastic elements 81, 181 as first and second holding portions that movably hold the electromagnets 60, 160. The elastic elements 81, 181 may be springs.

The electromagnet 60 is movably attached to the main body 51, and is urged by a push spring 81. Aback plate 80 is attached to the main body 51. The electromagnet 60 can be moved so that the electromagnet 60 gets into the back plate 80. A liquid 84 is sealed in between a core 61 of the electromagnet 60 and the main body 51. A seal member 83 formed by an O-ring is provided for preventing leakage of the liquid. Air has been mixed in the liquid 84 so as to prevent the core 61 of the electromagnet 60 and the main body 51 from having contact in a direct fashion.

The lower electromagnet 160 is also urged by a spring 181. The spring 181 is held by a back plate 180 attached to the main body 51. A liquid 184 is sealed in between a core 161 of the lower electromagnet 160 and the main body 51. A seal member 183 is provided for preventing leakage of the liquid 184. Air has been mixed in the liquid 184.

A bearing 59 is disposed between the main body 51 and a bearing portion 38 of the disc 30. Since the electromagnets 60, 160 are held by the springs 81, 181, the electromagnets 60, 160 can be moved in up-down directions. Specifically, a flange of the core 61, 161 of the valve-closing or valve-opening electromagnet 60, 160 which is used to secure the core 61, 161 to the main body 51 as a housing is provided with a piston structure, and is secured via a cylinder with the air-mixed liquid 84, 184 sealed in. Thus, each core 61, 161 is movably held. Therefore, it becomes possible to improve the closeness of contact between each core 61, 161 and the disc 30, and increase the electromagnetic force to be generated.

In the third embodiment, the coil 62 of the electromagnet 60 and the coil 162 of the electromagnet 160 may be of a single wiring, or of separate wirings.

It is to be understood that the embodiments disclosed herein are merely illustrative and not restrictive in any respect. It is intended that the scope of the invention is indicated by the appended claims, not by the foregoing description, and covers all the modifications that are within the scope of the claims and the meaning and scope of equivalents.

This invention can be used, for example, in the field of electromagnetically driven valves for internal combustion engines that are mounted in vehicle.

What is claimed is:

1. An electromagnetically driven valve that operates by a combination of electromagnetic force and elastic force, comprising:

a valve element that has a valve shaft and that reciprocates in directions of extension of the valve shaft;

a first oscillating member and a second oscillating member that extend from driving ends to pivoting ends, and that pivot about central axes extending at the pivoting ends, wherein the driving ends are operatively linked with the valve element;

a stem provided between the first oscillating member and the second oscillating member that transfers reciprocating movements of the first oscillating member and the second oscillating member to the valve element;

an electromagnet that oscillates the first oscillating member and the second oscillating member; a first measuring portion that measures at least one of an oscillation angle, an amount of lift and an oscillating speed of the first oscillating member;

a second measuring portion that measures at least one of an oscillation angle, an amount of lift and an oscillating speed of the second oscillating member; and a control portion that computes energization control logics based on measurement values provided by the first measuring portion and the second measuring portion, and that averages the energization control logics to control energization of the electromagnet.

2. The electromagnetically driven valve according to claim 1, wherein the control portion determines an amount of electric current supplied to the electromagnet and a duration of flow of electric current through the electromagnet.

3. The electromagnetically driven valve according to claim 1, wherein the electromagnet includes a plurality of coils, and the plurality of coils are connected with each other.

4. The electromagnetically driven valve according to claim 1, wherein the electromagnet includes a plurality of coils, and the plurality of coils are separated.

* * * * *